US009091169B2

(12) United States Patent
Guenther

(10) Patent No.: US 9,091,169 B2
(45) Date of Patent: Jul. 28, 2015

(54) FLUID FLOW IN A CONTROL ARRANGEMENT FOR A ROTARY PISTON ENGINE

(75) Inventor: Eggert Guenther, Bad Doberan (DE)

(73) Assignee: EN3 GmbH, Neubrandenburg (DE)

( * ) Notice: Subject to any disclaimer, the term of this patent is extended or adjusted under 35 U.S.C. 154(b) by 515 days.

(21) Appl. No.: 12/810,214

(22) PCT Filed: Feb. 19, 2009

(86) PCT No.: PCT/EP2009/051981

§ 371 (c)(1),
(2), (4) Date: Aug. 12, 2010

(87) PCT Pub. No.: WO2009/103766

PCT Pub. Date: Aug. 27, 2009

(65) Prior Publication Data

US 2011/0000460 A1 Jan. 6, 2011

(30) Foreign Application Priority Data

Feb. 19, 2008 (DE) ..... 10 2008 009 896

(51) Int. Cl.
*F01C 1/22* (2006.01)
*F01C 21/00* (2006.01)
*F01C 1/07* (2006.01)

(52) U.S. Cl.
CPC ..... *F01C 1/22* (2013.01); *F01C 21/008* (2013.01)

(58) Field of Classification Search
USPC ..... 418/54, 61.1, 182, 91, 94, 97
See application file for complete search history.

(56) References Cited

U.S. PATENT DOCUMENTS

| | | | | |
|---|---|---|---|---|
| 1,626,557 | A * | 4/1927 | Rolaff | 418/14 |
| 2006/0193739 | A1 | 8/2006 | Beaudoin | |
| 2006/0233653 | A1 * | 10/2006 | Trapalis | 418/54 |
| 2007/0128063 | A1 * | 6/2007 | Zelezny | 418/61.2 |

FOREIGN PATENT DOCUMENTS

| | | |
|---|---|---|
| DE | 522 299 | 4/1931 |
| DE | 1 077 916 | 3/1960 |
| DE | 95 574 | 2/1973 |
| DE | 196 28 867 | 1/1998 |
| JP | 56-48681 | 11/1981 |
| JP | 57-179333 | 11/1982 |
| WO | WO-03/098005 | 11/2003 |
| WO | WO-2004/088093 | 10/2004 |

* cited by examiner

*Primary Examiner* — Mary A Davis
*Assistant Examiner* — Paul Thiede
(74) *Attorney, Agent, or Firm* — Jordan and Hamburg LLP

(57) ABSTRACT

Kinematics of a rotary piston engine are guided by a sliding guidance mechanism mounted in a biangular piston. The mechanism is arranged relative to a fixed point of a housing having a runway formed with a single-arc trochoid. A sliding component moves within a groove in the piston. A housing-mounted pin is coupled to the sliding component and defines a rotating radius during motion relative to the piston. The piston has a minimal opening in a sidewall for the pin to couple to the sliding component allowing a maximal portion of the piston to be available for lateral fluid exchange during piston movement.

2 Claims, 15 Drawing Sheets

FLUID FLOW IN A CONTROL ARRANGEMENT FOR A ROTARY PISTON ENGINE

BACKGROUND OF THE INVENTION

This invention relates to the control of the piston of a rotary piston engine with a single-arc trochoid as housing runway.

In rotary piston engines such as the Wankel engines, the guidance of the piston kinematics normally takes place via a large internal gear. Such gear is placed in the piston at a housing side wall and mates with a smaller toothed wheel. At the same time, the eccentric shaft for the power take-off of the engine is guided through the smaller toothed wheel. The piston is arranged on a central journal bearing on the eccentric shaft in such a way that the piston can turn around the power shaft and, simultaneously, caused by the meshing of the gears, turns around itself. In the well-known Wankel engine the diameters of the toothed wheels, internal gear in the piston and external gear at the housing wall, have a ratio of 3 to 2, thereby forming a double-arc trochoid as the housing runway.

Rotary piston engines having a housing runway of the shape of a single-arc trochoid are especially suited for large changes in volume. Here the ratio of the diameter of the internal gear in the piston to the diameter of the external gear at the housing wall is 2 to 1. The piston of the engine has a biangular shape. A disadvantage, however, is that with an unsuited arrangement of the openings for the fluid change, short circuit flows may take place between inlet and outlet. These short-circuit flows can be avoided by having the fluid change take place via side openings in the housing side wall. However, the biangular piston has only a small area and it is difficult to arrange the side openings in such a way that they can be simultaneously opened and covered by the movement of the piston.

This difficulty can also be found in similar engines which are not rotary piston engines in the true sense of the word. An example for such a type of engine is the rotary piston engine of the Australian company Katrix Pty Ltd. An unfavourable feature of such engine is the fact that piston and power shaft are connected by a sliding guidance. In such a case it is, however, possible to select any housing runway as long as the piston rotation allows the points of the piston always to be conducted along the runway contour. When the points are always conducted along the runway contour, however, the resulting fluid power goes via the sliding guide on to the power conducting shaft. The consequences of this arrangement are high friction in the sliding pairs combined with high wear of the components. On the other hand, the resulting power of a rotary piston engine always acts on the eccentric so that in this case the power shaft leading through the engine can be dispensed with.

Another known guidance of the piston kinematics in rotary piston engines with a housing runway of the shape of a single-arc trochoid is arranged as is shown in FIG. 1. A special feature of this rotary piston engine is that the transmission of both toothed wheels is at a ratio of 2 to 1. According to the mathematic formation law, an imaginary vertical axis 6 going through a piston 1 always goes through a point 3 fixed to the housing 2; and a horizontal axis 7 going through a piston always goes through a point 4 fixed to the housing. Points 3 and 4 are at the same time points in a Cartesian coordinate system with the axes 8 and 9. For a power shaft with the centre 5 it is of no importance whether the rotation of the piston around itself is caused by the interaction of two toothed wheels 10 and 11 or by the sliding movement of the piston through the points 3 and 4.

In each case, resulting fluid power at the piston always goes through the eccentric centre point and has a lever arm to the centre of rotation 5 of the power shaft. The eccentricity of the rotary piston engine is the distance of the points 3, 4 to the centre 5. The tips of the piston stay free of the guiding forces. This kinematic principle has already been described in German patent DD 95574 A.

FIG. 2 shows that other rotating points can be chosen at the housing side wall for the purpose of a rotary sliding guidance. In FIG. 2, the axes 12 and 13 are running through the rotary sliding points 14 and 15. The axes 12 and 13 are turned towards the symmetry axes by an angle in FIG. 1. This angle can be chosen ad libitum according to the position chosen at the housing side wall for the rotary sliding points.

Although the guidance of the kinematics of the piston of a rotary piston engine with a single-arc housing contour with toothed wheels in the piston side presents an elegant and safe solution, a large area is occupied by a through power shaft. Also, a large area is occupied by a non-through power shaft. This is due to a positioning of a large internal gear next to the eccentric, which makes this space unavailable for the change of the fluid at the piston side area.

SUMMARY OF THE INVENTION

The present invention is directed to a guidance arrangement for a rotary piston engine which relies upon a housing-fixed point at one side of a housing. The housing provides a runway formed by a single-arc trochoid. The piston is biangular and includes a guideway groove. A rotary guidance mechanism is mounted within the piston and includes a first block or pin which moves within the guideway groove. Another block or pin is coupled to the first block or pin and to the housing-fixed point, allowing the rotary guidance mechanism to rotate relative to the housing-fixed point. The piston includes a minimal opening in a sidewall through which the rotary guidance mechanism extends allowing a maximal portion of the piston to be available for lateral fluid exchange.

DETAILED DESCRIPTION OF SPECIFIC EMBODIMENTS

Specific embodiments of the present invention present solutions for the fluid change across side areas by means of different guiding systems, especially for very small engines and without involving a through power shaft.

In specific embodiments a sliding guidance arranged inside the piston in such a way that only one guiding pin, that is mounted in the housing side wall, reaches into the piston through a minimal central opening in the side area of the piston and forms a rotary sliding guidance with runways in an internal space of the piston.

In other embodiments a straight groove is in the piston area under an arbitrary angle crossing the piston centre. The straight groove has a rotating pin fixed in it, which serves the supply of the fluid. For this purpose, the rotating pin is designed as a pipe which at the one end running in the groove is flattened to meet the width of the groove. The admission of the fluid into the engine takes place controlled via this pipe canal as soon as there is a definite position between rotary pin and guiding groove in the course of the movement or a certain rotary angle of the piston is reached in such a way that through a guidance canal in the piston, which is then covered by the rotary pin, the fluid is lead into a working room of the engine.

In some embodiments the guidance of the piston kinematics takes place by having two double-cross guideways arranged in the motion plane of the piston. Two sliding blocks joined by a joint coupling can move in both cross guideways, while the piston and a rotating disc containing one of the cross guideways rotate in the same rotary direction at the same angular velocity. To achieve this, the centre points of the joint bearings of the coupling have the distance of the centre point of the eccentricity of the engine, given by the distance between the centre of the eccentric in the piston and the centre of the power shaft, and the housing-fixed cross guideway has a rotary axis in common with the power shaft. Thus a very small impairment of the piston side area, available for the lateral fluid inlet, can be achieved.

In some embodiments of the present invention, a cylindrical pin is fixed at the housing and reaches into a lateral central piston opening. A further cylindrical piston-fixed pin is mounted in the centre of the opening, with the piston-fixed pin having twice the diameter of the housing-fixed pin, both pins having teeth. A tooth belt surrounds both pins so that a rotation of the piston results in a relative rotation around the power shaft. The lateral opening in the piston creates a large free area in the piston for the application of elements for the fluid change in the housing wall.

In some embodiments the guidance of the piston kinematics includes a toothed wheel that combines both toothed pegs as an intermediate wheel instead of a tooth belt.

Figure 1:
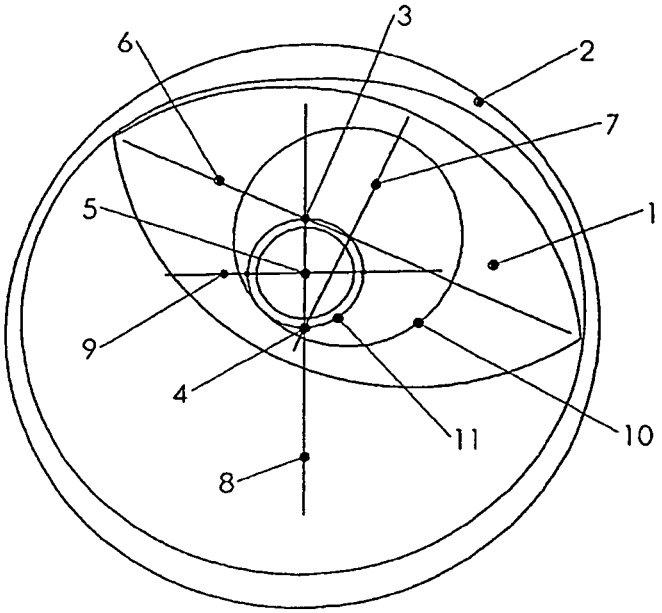
Fig. 1 (Prior Art)
FIG. 1 is a diagram of a portion of conventional rotary piston engine with a runway in the shape of a single-arc trochoid.
Figure 2:
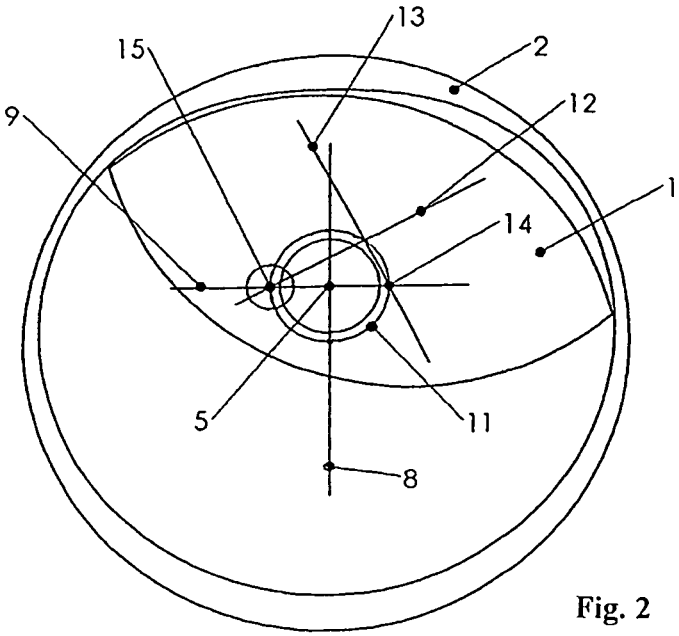
Fig. 2 (Prior Art)
FIG. 2 is another diagram of the rotary piston engine of FIG. 1, showing other rotary points at the housing wall area that can be chosen for the task of a rotary sliding guidance.
Figure 3:
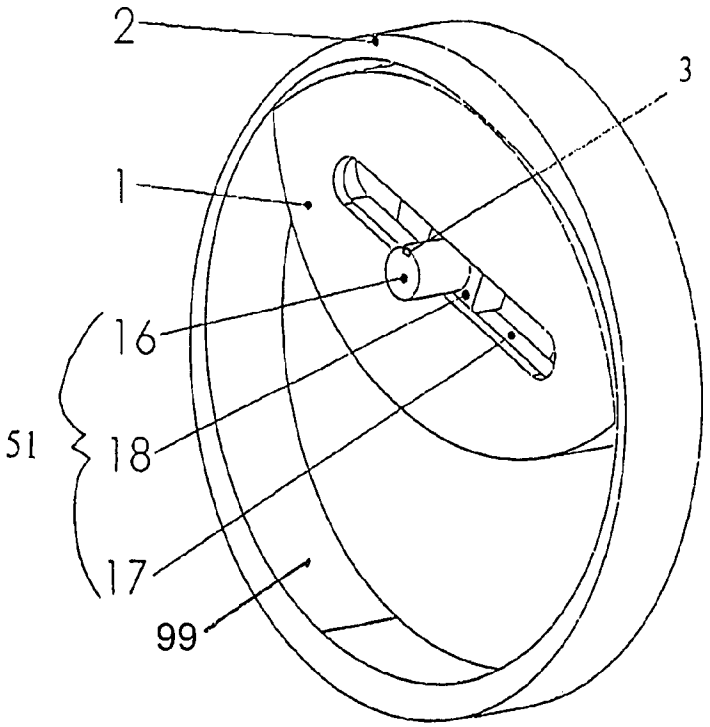
FIG. 3 is a diagram of a portion of a rotary piston engine according to an embodiment of the present invention.
Figure 4:
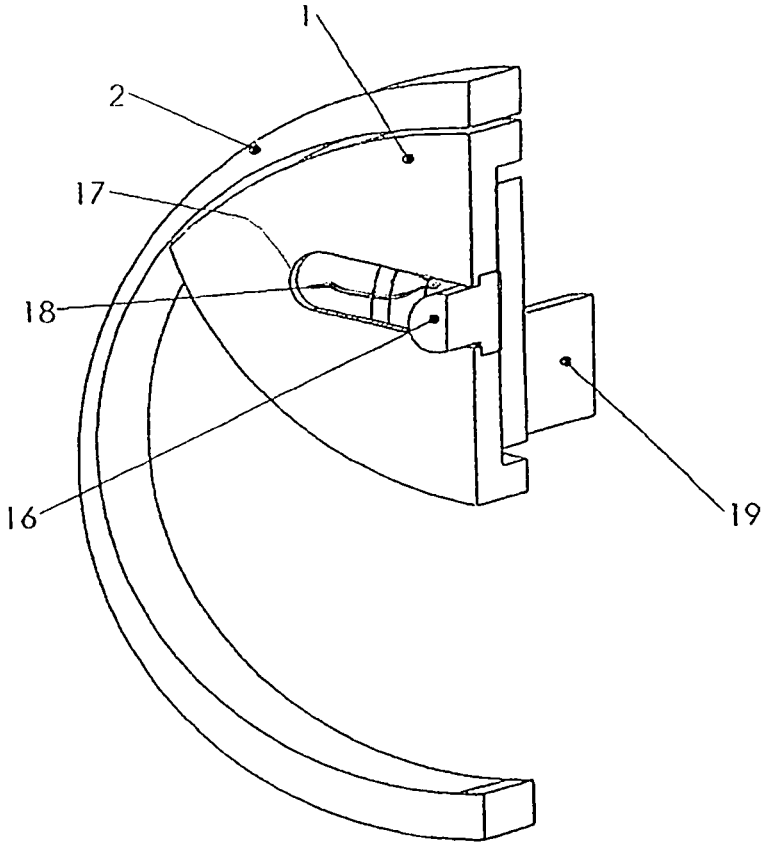
FIG. 4 is sectional diagram of the rotary piston engine of FIG. 3.
Figure 5:
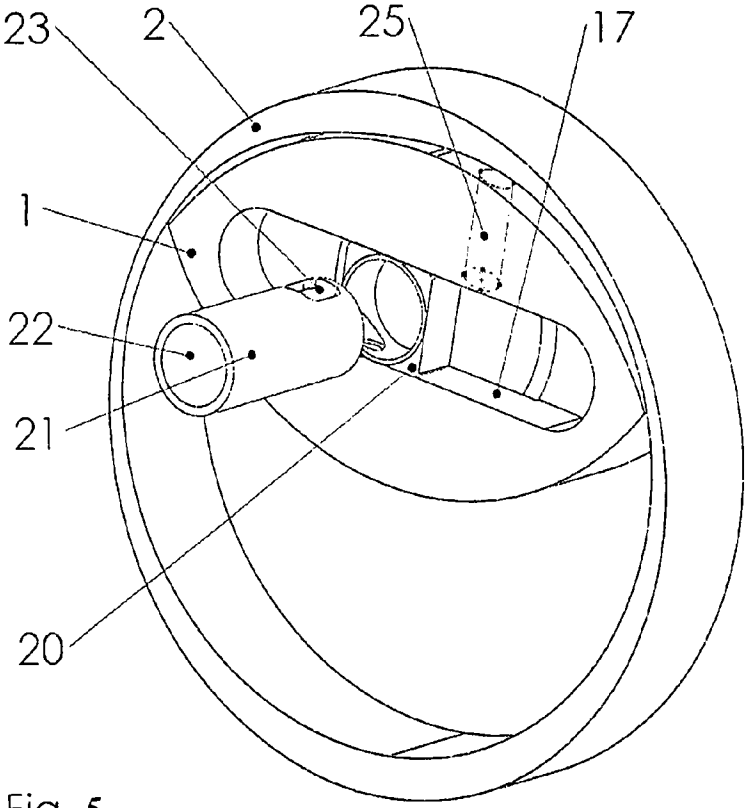
FIG. 5 is a diagram of a portion of a rotary piston engine according to another embodiment of the present invention.
Figure 6:
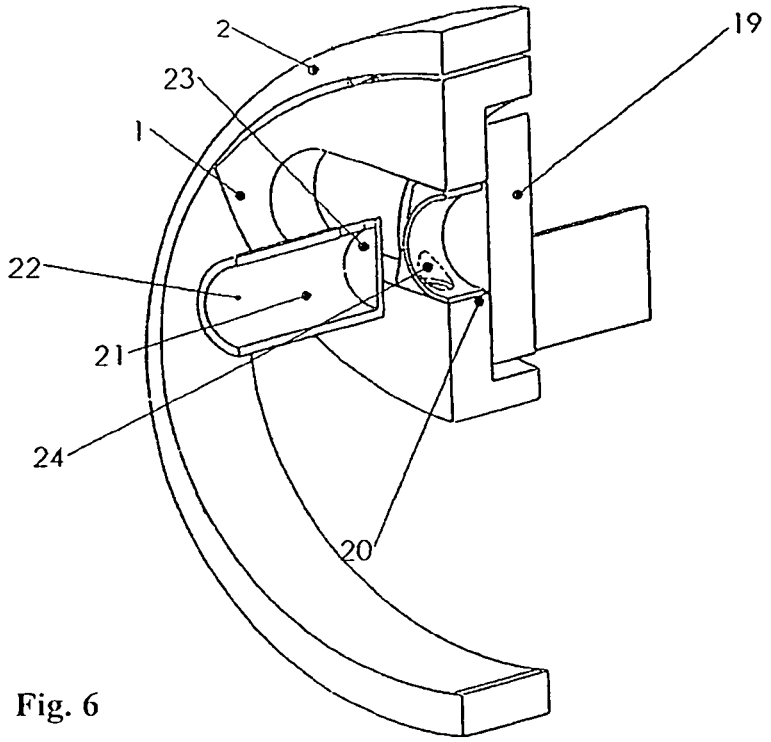
FIG. 6 is sectional diagram of the rotary piston engine of FIG. 5.
Figure 7:
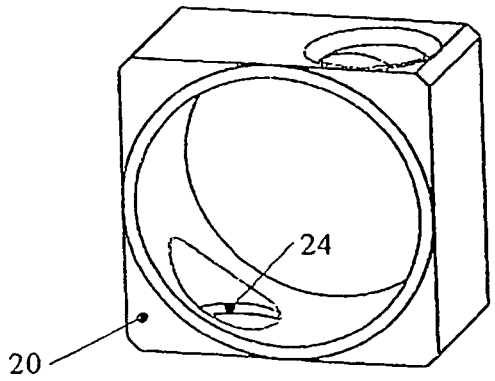
FIG. 7 is a diagram of a sliding block portion of the engine of FIG. 5.
Figure 8:
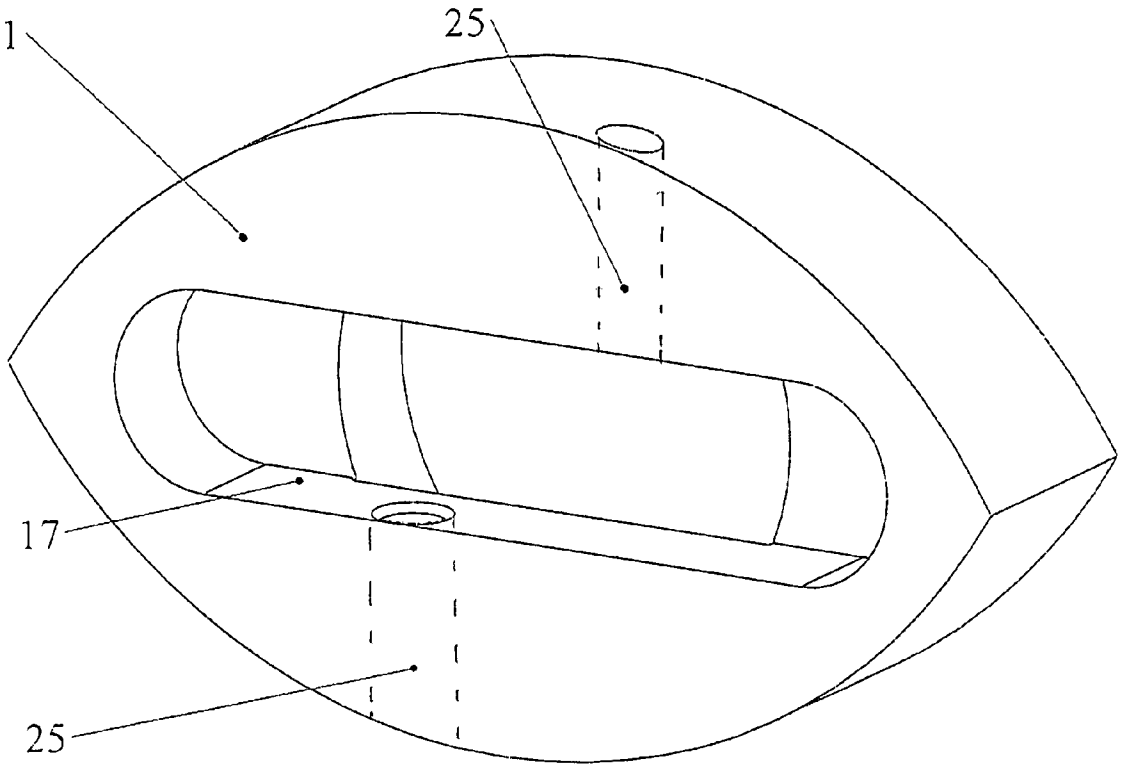
FIG. 8 is a diagram of the piston of the engine of FIG. 5.
Figure 9:
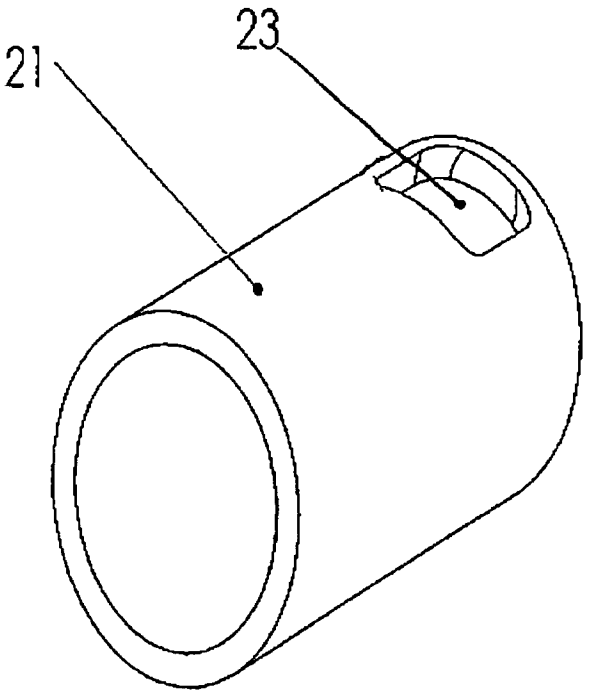
FIG. 9 is a diagram of the rotating pin of the engine of FIG. 5.

FIGS. 3 and 4 show piston 1 sitting on the eccentric 19. A groove going through the piston centre has guideways 17 for guiding the sliding block 18. The guideways 17, sliding block 18, and eccentric 19 together serve as guidance mechanism 51. The groove is located on the side of the piston 1 averted from the power shaft. A rotating pin 16 reaches into piston 1 in such a way that the groove guideways 17, requiring a larger space, do not reduce the piston side area at piston 1 for a lateral fluid guidance more than necessary for the freedom of movement of the rotating pin 16.

Because of the acting fluid forces, the piston rotates around the power shaft. Here it is guided by the eccentric 19. At the same time, piston 1 has to rotate around the eccentric 19 due to the guiding action of the sliding block 18. Sliding block 18 moves relative to piston 1 in the groove guideway 17 between the end positions of the piston groove at full revolution of piston 1. As the resulting fluid power always goes through the centre of eccentric 19, the groove guideway 17 and sliding blocks 18 form a theoretically power-free yielding coupling. This is true for the design of a freely rotating pin 16 on which the sliding block 18 is fixed as well as for the design of a housing-fixed rotating pin 16 on which sliding block 18 can freely rotate. In reality there are, however, small forces in the guidance building elements due to the mechanical friction in the power-carrying elements.

FIGS. 5-9 are directed to an embodiment in which the piston guidance combines the principle of a sliding block 20 movable on a fixed pin with a direct supply of fluid via the rotating pin 21. For this purpose, pin 21 has the bore 22 and the lateral opening 23 for the access of the fluid to sliding block 20. At a certain position during the movement of the piston 1, the sliding block 20 covers the opening 23 of the rotating pin 21 and the canal 25 pointing into the upper small working space of the engine. The geometric coordination of the openings or canals 23, 24 and 25 is tuned to the rotating angle position of piston 1 so that a feeding of the working space takes place. Canals 23, 24, 25 also may be referred to as channels. At specific positions during rotation of the piston 1 the channels 23, 24, 25 interconnect.

By a rotation of pin 21 from the outside in its housing-fixed position, the angle of rotation and the duration of feeding can be changed in an operationally suitable way.

Figures 10A, 10B:
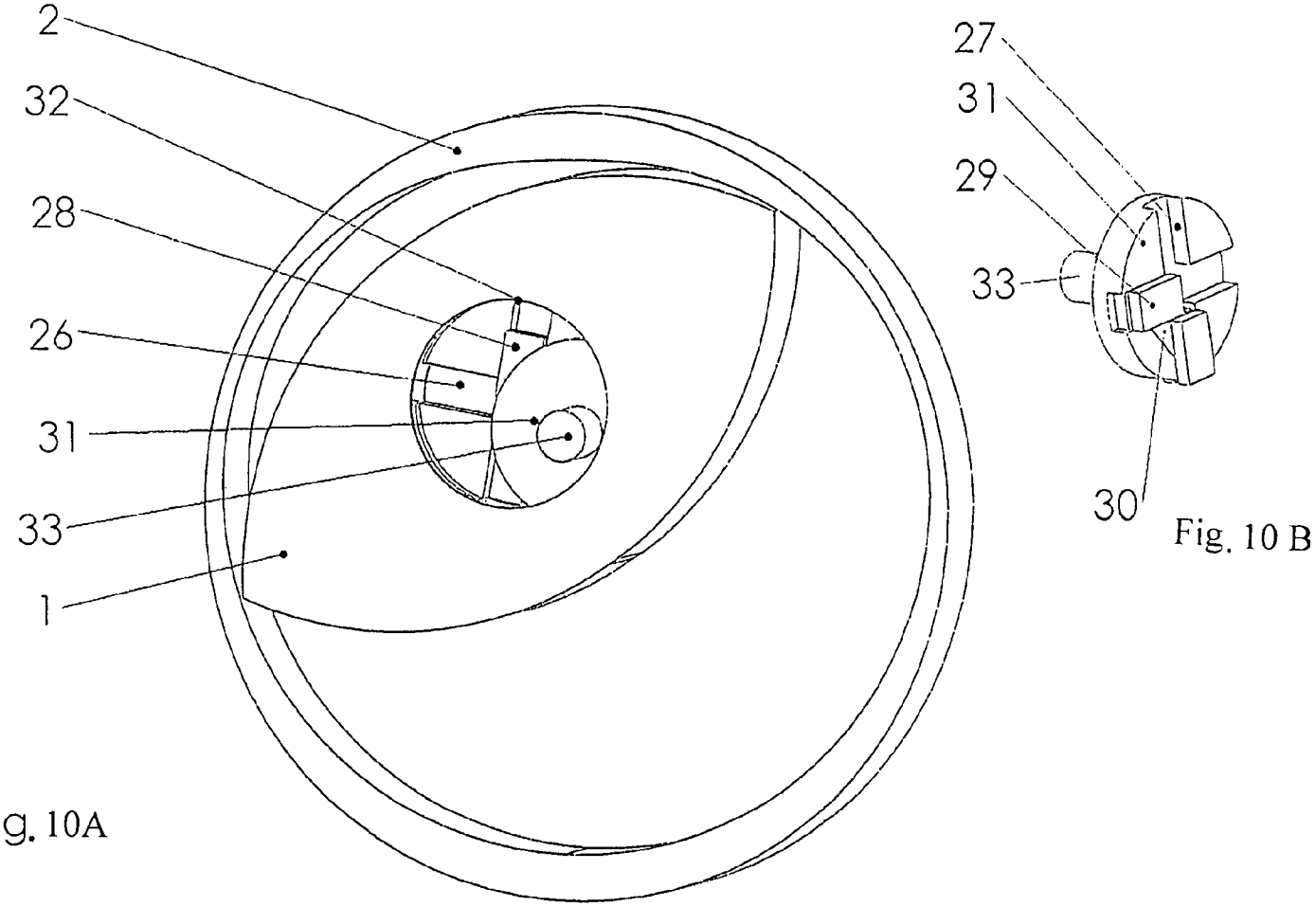
FIG. 10A is a diagram of a portion of a rotary piston engine according to another embodiment of the present invention.
FIG. 10B is a diagram of a sliding block of the rotary piston engine of FIG. 10A.
Figure 11A:
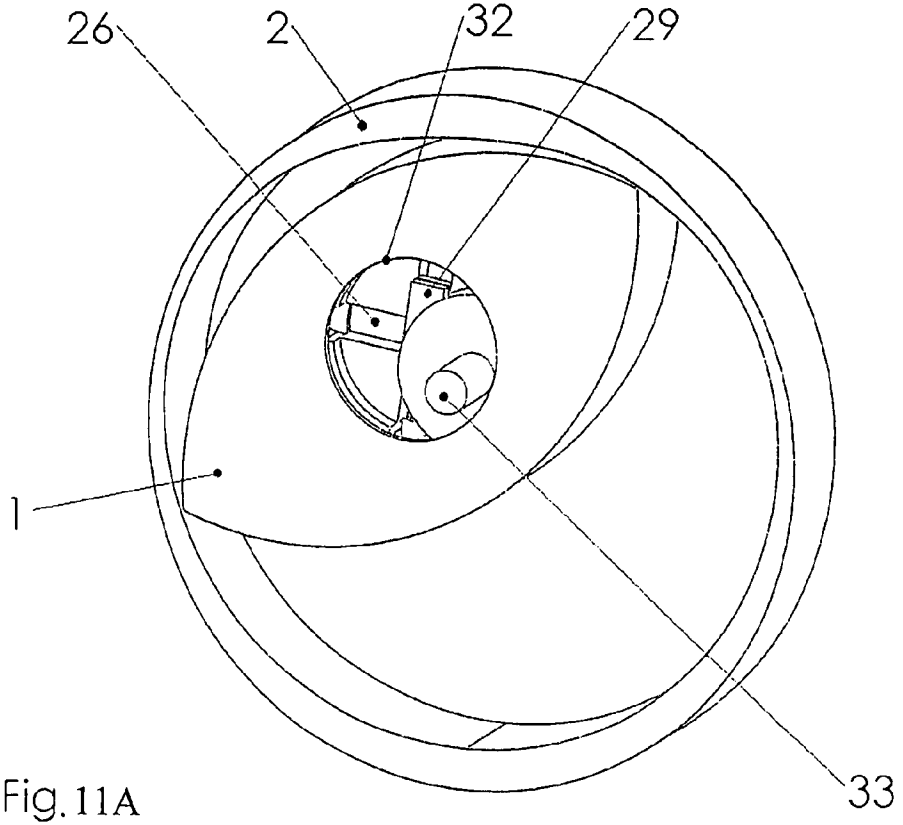
FIG. 11A is another diagram of a portion of the rotary piston engine of FIG. 10A.
Figure 11B:
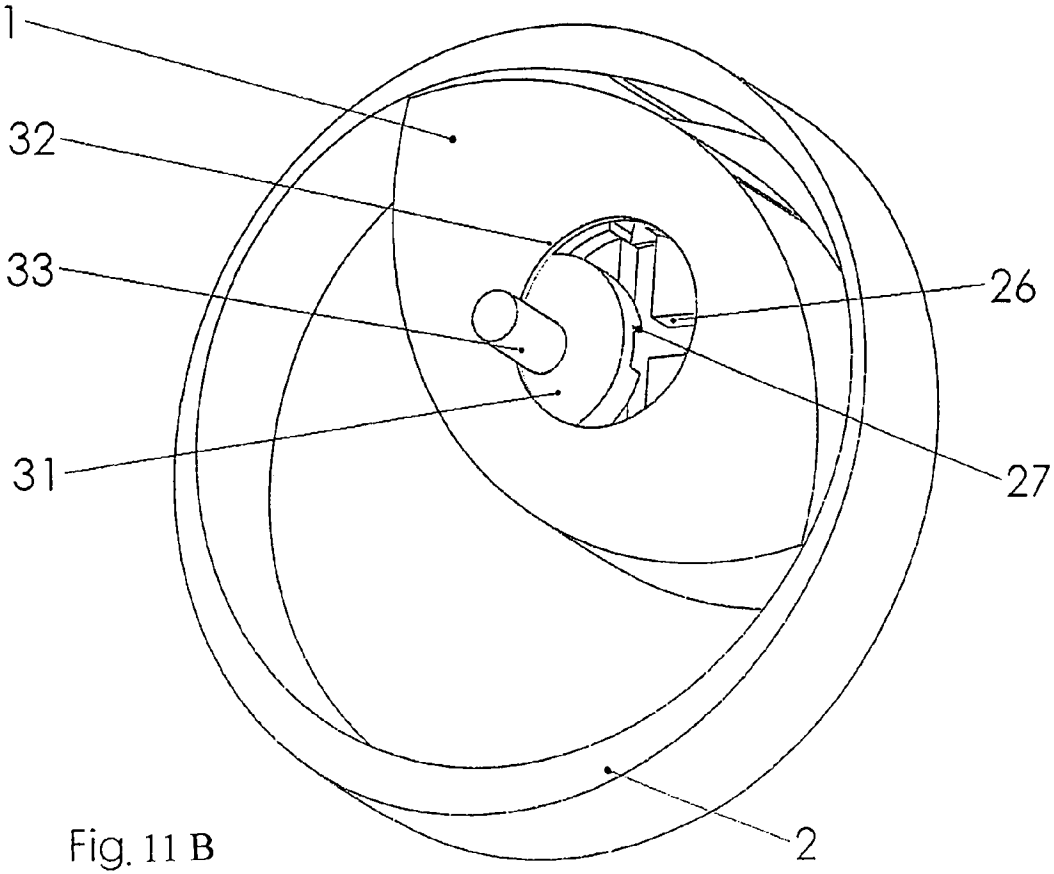
FIG. 11B is yet another diagram of a portion of the rotary piston engine of FIG. 10A.
Figure 11C:
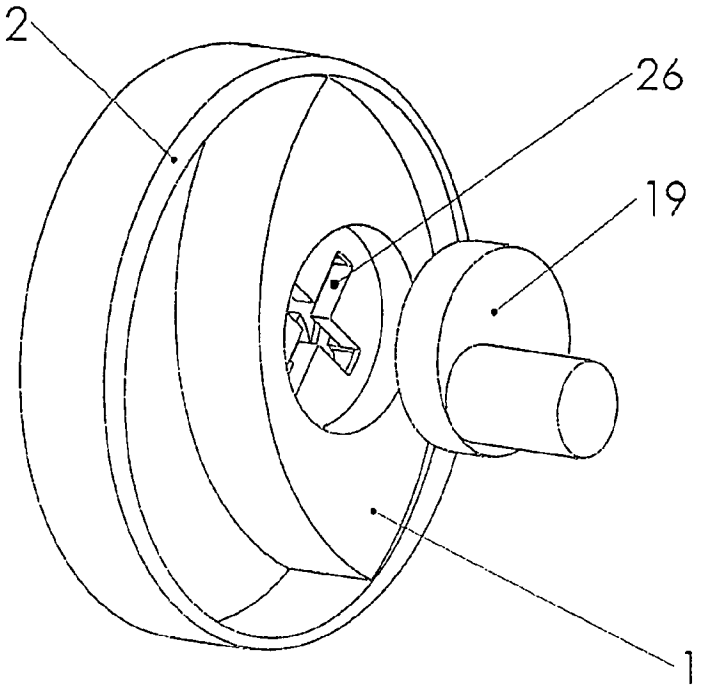
FIG. 11C is still a partially exploded view of the rotary piston engine of FIG. 10A.

Referring to FIGS. 10 and 11, inside piston 1 and in the lateral piston centre, there is the cross guideway 26 in which the sliding blocks 28, 29 are moving. Sliding blocks 28, 29 are designed to form double blocks having a shaft part in their centre which serves as a bearing for joint coupling 30. Simultaneously, sliding blocks 28, 29 move in cross guideway 27. There is a distance in the planes between the two cross guideways allowing the passage of joint coupling 30.

Rotating disc 31, in which the cross guideway 27 is mounted, has its housing-fixed rotating bearing in point 5, which at the same time is passed by the rotating axis of the power shaft of the engine. This arrangement allows the reduction of the lateral opening 32 in piston 1 to a diameter measure which is twice the engine eccentricity and the radius of the rotating bearing pin 33 and thus forms the precondition for a free design of the fluid inlet at the piston side.

The distance of the centre of the bearings of joint coupling 30 is for a single-arc trochoid runway of a rotary piston engine identical with its eccentricity.

In FIG. 10, the eccentricity corresponds to the distance between the centre of the eccentric and the centre of the rotating disc 31.

For the free movement of rotating disc 31 inside piston 1, bore 32 has been inserted at the required component height.

Figure 12:
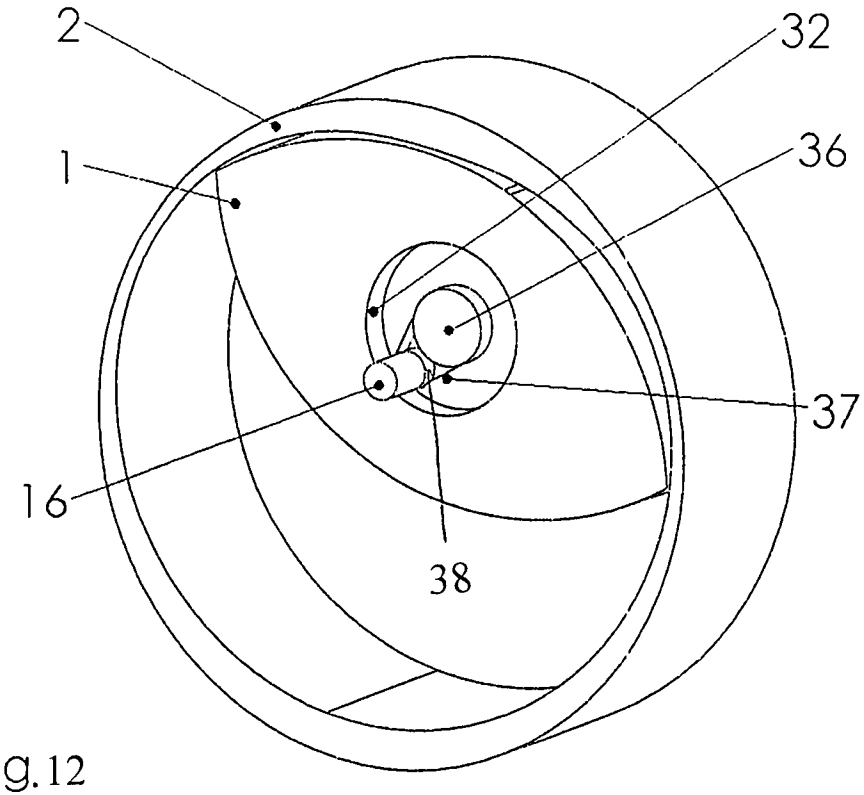
FIG. 12 is a diagram of a portion of a rotary piston engine according to another embodiment of the present invention.
Figure 13:
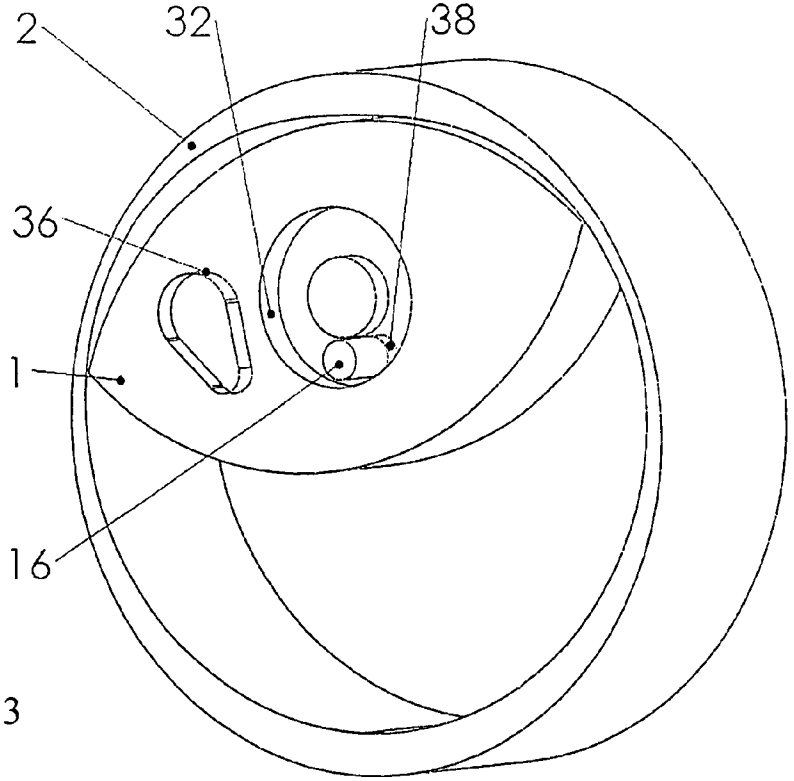
FIG. 13 is another diagram of a portion of the rotary piston engine of FIG. 12.

Referring to FIGS. 12 and 13, the course of piston 1 in the trochoid runway 99 (see FIG. 3) of housing 2 is obtained by mounting a housing-fixed cylindrical peg 16 in the lateral housing part of the engine. The peg sits in the axial alignment of the power shaft reaching into opening 32 of piston 1. Thus, when the piston moves around its axis there is free movement. Opening 32 contains the cylindrical piston-fixed tooth pin 36 in axial alignment to the piston axis. The relation of the diameter of both pegs/pins is 1 to 2, and thus corresponds to the mathematical condition for generating a single-arc trochoid. Pin 16 at the housing and pin 36 at piston 1 are fitted with teeth, so that a tooth belt can be mounted around the two pins. Accordingly, at the rotation of the power shaft, a rotation of piston 1 may occur, without backlash, around its axis with half the angular velocity of the power shaft in the same sense of rotation. The dimension of opening 32 can result in a minimal limitation of the lateral piston area.

Figure 14:
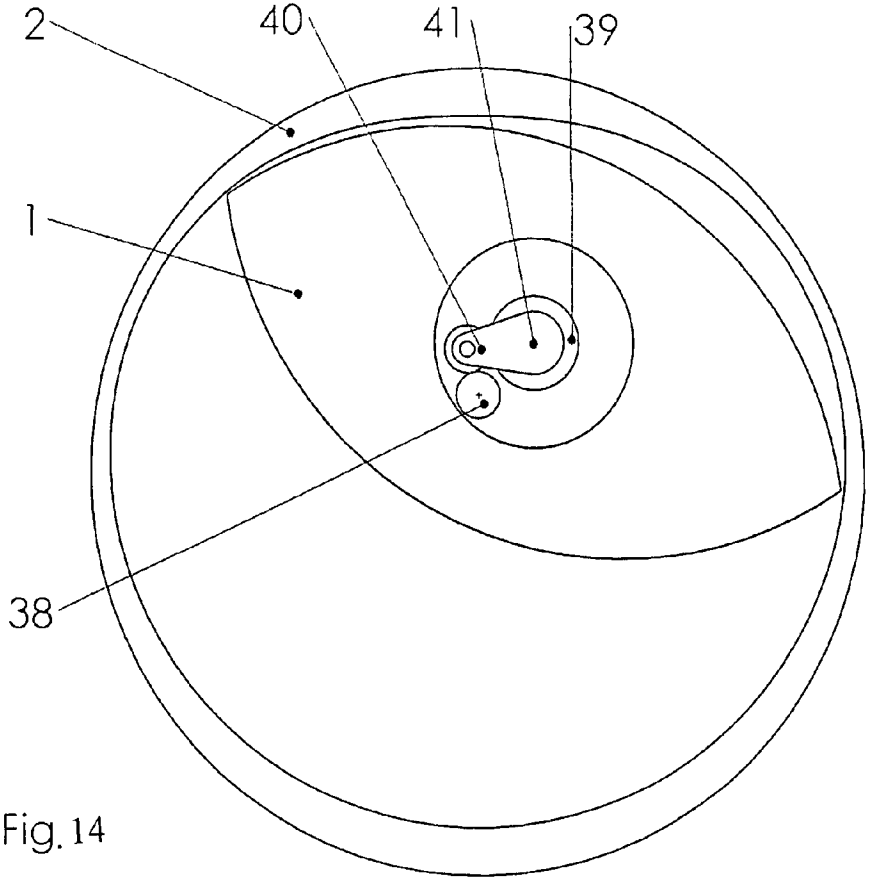
FIG. 14 is a diagram of a portion of a rotary piston engine according to another embodiment of the present invention.
Figure 15:
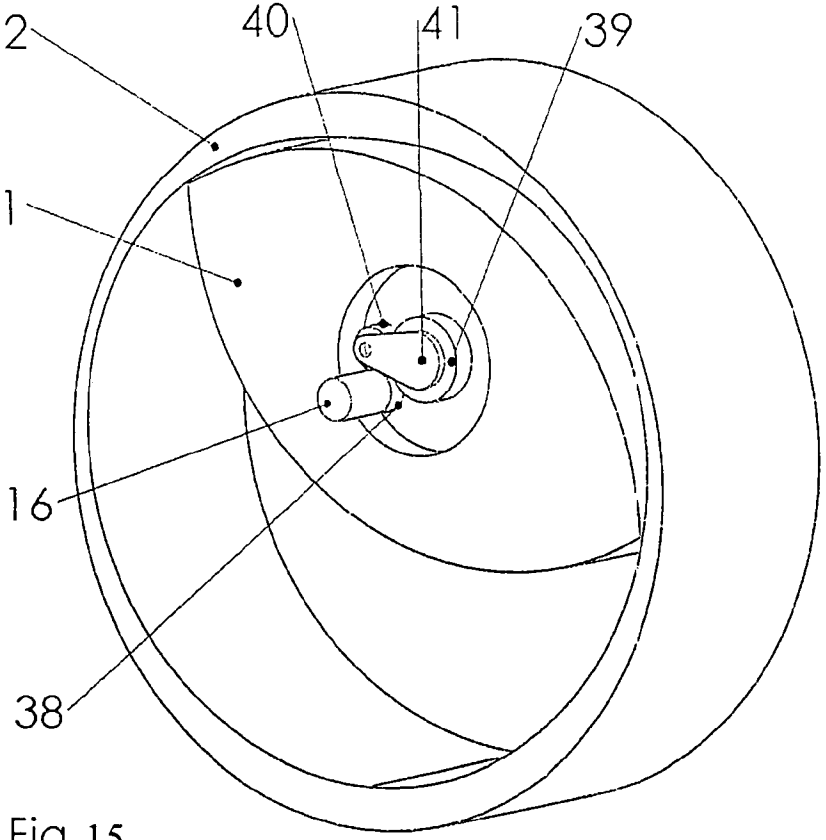
FIG. 15 is another diagram of a portion of the rotary piston engine of FIG. 14.

FIGS. 14 and 15 show an arrangement corresponding to a three-shaft planetary gearing. The gearing consists of gear 38, mounted concentrically on the housing-fixed pin 16; the piston-fixed gear 39 aligned with the piston axis; and the intermediate wheel 40 as well as of the link fixed at wheel 41. The transmission ratio of the wheels 38 and 39 is 1 to 2, so that during the rotation of the power shaft piston 1 turns in the same sense of rotation with half the angular velocity. The gearing arrangement can be mounted in a minimal opening 32 (see FIG. 13) in the side of the piston.

The invention claimed is:

1. A control arrangement for a rotary piston engine, comprising:

a housing having a runway formed by a single-curved trochoid;

a two-cornered piston; and a guidance mechanism for rotating and sliding the piston relative to a side of the housing, the guidance mechanism including a guide track formed in the piston, a sliding block extending into the piston and guided by the guide track, and a pin having an axial throughbore through which fluid is guided into the piston; and wherein the pin includes a radial throughhole communicating between the axial throughbore and a periphery of the pin, the radial throughhole in the pin being located in a section of the pin which extends into the sliding block;

wherein the sliding block is coupled to the pin and includes a plurality of inner connecting channels which guide fluid between the radial throughhole in the pin and channels in the piston; and wherein when the control arrangement operates and the pin movingly rotates within the sliding block so that the radial throughhole is in communication with at least one of the plurality of inner connecting channels of the sliding block and the sliding block further moves in the guide track so that the at least one inner connecting channel aligns with at least one channel of the piston, a fluid path is configured along which the fluid flows through the piston to a working room of the rotary piston engine, the fluid path comprising the axial throughbore of the pin, the radial throughhole of the pin, the at least one inner connecting channel of the sliding block, and the at least one channel of the piston.

2. A control arrangement for a rotary piston engine, comprising:

a housing having a runway for a single-curved trochoid;

a two-cornered piston having an opening and an outer surface within which said opening is located; and a guidance mechanism configured to allow rotation and sliding of the piston relative to a side of the housing, the guidance mechanism including a guide track formed in the piston and a sliding block located within the piston and guided by the guide track; and wherein the sliding block is disposed in the guide track so that an outer surface of the sliding block has a facing, spaced relationship with said outer surface of the piston along an entire length of the guide track;

wherein the guidance mechanism further includes a pin coupled to the sliding block and protruding through said opening, the pin being provided with an axial throughbore through which fluid is guided into the piston;

wherein when the control arrangement operates and the pin movingly rotates within the sliding block so that a radial throughhole of the pin is in communication with at least one of a plurality of inner connecting channels of the sliding block and the sliding block further moves in the guide track so that the at least one inner connecting channel aligns with at least one channel of the piston, a fluid path is configured along which the fluid flows through the piston to a working room of the rotary piston engine, the fluid path comprising the axial throughbore of the pin, the radial throughhole of the pin, the at least one inner connecting channel of the sliding block, and the at least one channel of the piston.

* * * * *